United States Patent [19]

Fink

[11] 4,014,387

[45] Mar. 29, 1977

[54] APPARATUS AND PROCESS FOR DRAWING WATER FROM A WATER-BEARING STRATA

[75] Inventor: Leonhard Fink, Frankfurt, Germany

[73] Assignee: Thyssen Plastik Anger KG, Munich, Germany

[22] Filed: Jan. 10, 1975

[21] Appl. No.: 540,002

[30] Foreign Application Priority Data

Jan. 11, 1974 Germany ..... 2401327

[52] U.S. Cl. ..... 166/314; 166/105; 166/235

[51] Int. Cl.[2] ..... E03B 3/18; E21B 43/08

[58] Field of Search ..... 166/314, 105, 235, 236, 166/241

[56] References Cited

UNITED STATES PATENTS

| | | | |
|---|---|---|---|
| 1,588,920 | 6/1926 | Trahan et al. | 166/236 |
| 2,257,344 | 9/1941 | Maloney | 166/236 |
| 2,357,589 | 9/1954 | Holmes | 166/241 |
| 2,525,897 | 10/1950 | Greene | 166/236 |
| 2,622,683 | 12/1952 | Silitch et al. | 166/236 |
| 2,696,264 | 12/1954 | Colmerauer et al. | 166/235 |
| 2,973,814 | 3/1961 | Adams et al. | 166/236 |
| 3,280,911 | 10/1966 | Strange et al. | 166/228 |
| 3,357,564 | 12/1967 | Medford, Jr. et al. | 166/236 |
| 3,425,490 | 2/1969 | Clayton | 166/236 |
| 3,683,056 | 8/1972 | Brandt et al. | 166/236 |

*Primary Examiner*—James A. Leppink
*Attorney, Agent, or Firm*—Edmund M. Jaskiewicz

[57] ABSTRACT

In order to draw water free of sand from a well bored into a water-bearing strata a cylindrical permeable body is located concentrically within the perforated wall of the well. The cylindrical body may in turn comprise concentric outer and inner slotted tubes with a permeable cylinder or a granulate therebetween. The lower end of the cylindrical body is closed and the upper end is connected to a pump.

10 Claims, 6 Drawing Figures

FIG. 1
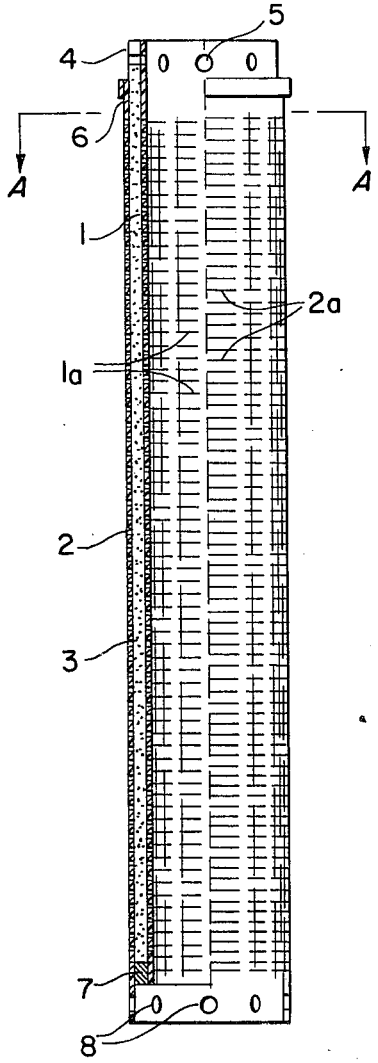
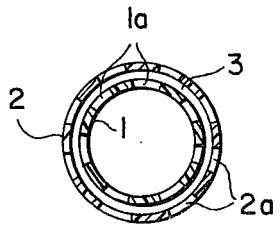
FIG. 2
FIG. 3
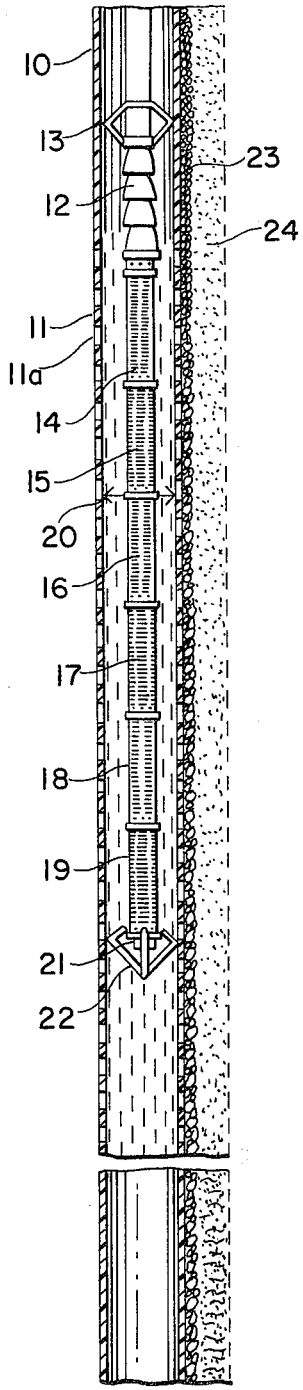

FIG. 4
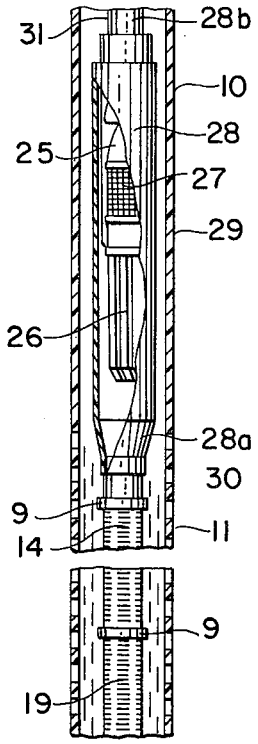
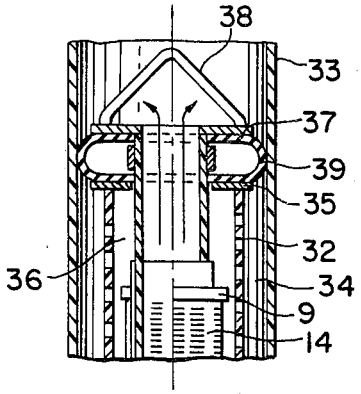
FIG. 5
FIG. 6
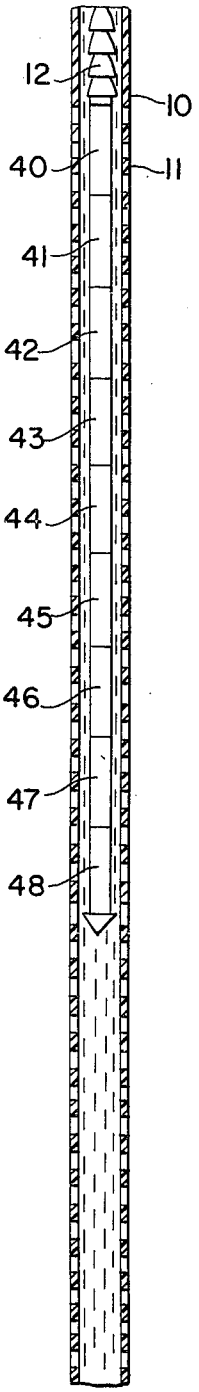

APPARATUS AND PROCESS FOR DRAWING WATER FROM A WATER-BEARING STRATA

The present invention relates to the drawing of water from a well bored into water-bearing strata, more particularly, to an apparatus and process for withdrawing such water in a sand-free condition.

In many areas of the United States and in many countries of the world the drawing of water from wells is relatively uneconomical because of the high cost of drilling a well and also because the water drawn from water-bearing sand strata generally contains fine sand. The sand content of such water causes problems, particularly in agricultural areas where such well water is necessary for successful cultivation of crops. In many tropical countries no rain may fall for several years and accordingly all water used for agriculture must come from ground water when no natural rivers are available as sources of water.

The water obtained from drilled wells generally has entrained sand and such wells must be replaced by new wells after being in operation for only a few years. The pumps operating in such wells are subjected to a very great wear because of the eroding action caused by the sand contained in the water passing through the pump. Thus the pumps require high repair costs and must be replaced after a relatively short operating life. Since the water-bearing strata vary from one another such strata are susceptible to a progressive decay or shrinkage. The continuous withdrawal of sand from the strata may cause a sinking of the soil above the strata since the strata fails to fully support the surrounding earth.

While it has long been known that such wells are relatively uneconomical no processes or apparatus have been developed to date which could substantially stop or prevent the sand from being entrained in the water to be conveyed by the pump. Various forms of filters have been mounted in direct connection with the pump in order to prevent the sand passing into the pump. However, this was not satisfactory since the filtration within the well itself inevitably led to a very rapid silting accummulation in the well.

It is therefore the principal object of the present invention to provide a novel and improved apparatus and process for drawing sand-free water from wells drilled in water-bearing strata.

It is another object of the present invention to provide such a process and apparatus which is simple in construction, reliable in operation and relatively inexpensive to manufacture and install.

According to one aspect to the present invention a process for drawing water free of sand from a well drilled into a water-bearing strata may comprise the steps of flowing the water from water-bearing strata into a perforated wall of the well. The water is then flowed through a permeable body and subsequently the water is pumped from the well.

According to another aspect of the present invention an apparatus may comprise a perforated tubular filter element defining a well wall and a cylindrical permeable body disposed concentrically within the well wall. The lower end of the body is closed and the upper end is open and connected to a pump. The cylindrical body may comprise concentric outer and inner slotted cylinders with a granulate defining a permeable body or a permeable cylinder between the concentric tubes.

Other objects and advantages of the present invention will be apparent upon reference to the accompanying description when taken in conjunction with the following drawings, which are exemplary wherein;

FIG. 1 is an elevational view partially in section of an element according to the present invention for suction current control;

FIG. 2 is a sectional view taken along the line A—A of FIG. 1;

FIG. 3 is a longitudinal sectional view of a well incorporating the suction current control element of the present invention;

FIG. 4 is a portion of the view of FIG. 3 and showing a modification of the present invention;

FIG. 5 is a portion of a view of FIG. 4 in enlarged scale and showing still another modification; and FIG. 6 is a view similar to that of FIG. 3 and illustrating a suction control element according to the present invention comprising a plurality of elements.

Proceeding next to the drawings wherein like reference symbols indicate the same parts throughout the various views a specific embodiment and modifications of the present invention will be described in detail.

According to the invention and as will be described in greater detail a permeable cylindrical body closed on its lower end is spaced concentrically in the interior of the well below the pump and this permeable cylindrical body functions to control the suction current. The suction current or flow of water horizontally in the well is kept away from the water-bearing strata and the pumping action of the pump is distributed uniformly over a predetermined length of the perforated well wall. The normal flow of water from water-bearing sands is approximately 5 millimeters per second and thus without any suction or intake force by the pump that quantity of water will seep into the well. Thus quantity of water will correspond to the maximum quantity of water discharged by the pump. The current control of the permeable body is selected to have such a porosity or permeability that this quantity of water to be pumped can flow into the interior of the current control element without any force. Within this control element in accordance with the present invention the rate of flow of the water thus corresponds to the characteristics of the pump.

This control of water flow in the interior of the well simultaneously eliminates turbulence of water in the well and keeps the entire well free of accumulating any depth of water therein. This prevents premature clogging of the lower positioned filter parts and the drilled well will remain capable of functioning for several decades.

The required total length of such a suction current control element will depend on the characteristics of the well and the characteristics of the pump and can be readily calculated on the basis of this technical data.

In FIG. 1 there is illustrated a suction current control element according to the present invention which comprises a pair of concentric slotted tubes 1 and 2 and a granulate 3 having a certain permeability filled between the tubes.

The inner tube 1 is formed of a suitable synthetic plastic material such as PVC with a smooth inner wall and is provided with a plurality of transverse slots 1*a*. A ring 4 also of PVC is mounted on the outside of the upper end of the inner tube 1 to provide a connecting nipple. The inside of the ring 4 is smooth and is not provided with any slots. The lower end of the tube 1 functions as a thrust bearing for the connecting nipple of the next succeeding element to be connected thereto but not shown in the drawing.

The shaped nipple 4 is provided with a plurality of threaded bores 5. The number of bores 5 will depend on the diameter of the ring 4. If desirable, the bores may be reinforced by metal nuts embedded in the ring 4 and surrounding the bores.

The inner tube 1 is surrounded by a concentrically disposed outer tube 2 preferably of the same material such as PVC but having a somewhat greater diameter and also provided with a number of transverse slots 2*a*. The slots may have a maximum width of about 1 millimeter. The lower end of the outer tube 2 forms a loosely fitting connecting sleeve to the nipple of the next lower succeeding element. The internal diameter of outer tube 2 is about 50 millimeters greater than the outer diameter of the inner tube 1 and the space between the tubes is filled by a granulated filling 3 of a hard material such as plastic synthetic material granulate, washed grit particles or similar materials. The granulate material 3 may comprise particles all of the same size or may comprise particles of a plurality of different sizes. The granulate fill 3 is enclosed between the tubes 1 and 2 by closure rings 6 and 7. The connecting sleeve portion on the bottom of the outer tube 2 is provided with a plurality of bores 8 to receive metallic screws necessary for connecting to the nipple. The upper end of the outer tube is provided with a securing ring 9.

The suction current control element as shown in FIGS. 1 and 2 wherein the inner tube 1 is surrounded by the outer tube 2 and a filling 3 of hard granular material insures the rigidity of the element which is necessary in order to absorb impact loads arising from switching on and off of the pump. While the filling 3 has been described above as consisting of a granulate it is to be noted that the filling may also comprise a cylindrical member of a predetermined permeability or porosity. It is pointed out that where the suction current control element has relatively small diameter the individual elements can be connected through threaded connections.

A complete suction current control element is illustrated in a drilled well in FIG. 3. The well casing from the ground surface of the terrain to the water-bearing strata comprises solid steel tubes 10 to which the well filters 11 or perforated tubular elements are connected by threaded connections or by welding. The perforated sections 11 are provided with relatively wide slots 11*a*. A pump 12 is positioned in the well and is mounted concentrically within the well casing 10 by means of a guide 13. The individual elements of the suction current control element are designated at 14–19 and begin below the pump 12 and are preferably connected directly to the pump as shown in the drawing. Centering guides 20 are provided at the connections between the individual control elements 14–19 so that the entire suction current control unit is positioned concentrically within the well casing. The concentric positioning of the unit assures that its function will be performed properly.

The lower end of the suction current control element is closed at 21 and the lower end is also provided with a centering guide 22. The connection of the individual control elements in the well is facilitated and obtained by the locking ring 9 at the upper end of the control element as shown in FIG. 1. The well casing 10 and 11 is surrounded by large-sized particles such as rocks or suitable particulate material indicated at 23 to retain and hold back the water-bearing fine sand 24. The concentric positioning of the control element within the well enables the space between the interior of the well casing and the outer wall of the suction current control unit 14–19 to remain free of sand during the time that the water is being drawn by the pump 12.

The suction current control element according to the present invention is shown in FIG. 4 as being used in conjunction with a submerisible pump in a drilled well. A multistage pump 25 having an electric motor 26 and a suction or intake opening 27 is surrounded by a cylindrical casing or envelope 28 in such a manner that an annular space is formed between the pump 25–27 and the casing. This space enables the water which is to be pumped to reach the suction opening 27 of the pump from below. Between the casing 28 and the solid casing 29 of the well there is also a free space so as not to present any hindrance to water which may be disposed above the pump during the lowering of the water level. The casing 28 has at its lower end a conical member 28*a* which reduces the diameter of the casing and connects to a connection 30 for the suction current control element 14–19. The pump 25–27 is positioned within the solid portion 10 of the well casing and the first element 14 of the suction control element is at the same depth as the first perforated portion 11 of the casing. Water is pumped upwardly from the pump through a discharge pipe indicated at 28*b* and the electrical cable for supplying energy to the pump is indicated at 31.

In the modification of FIG. 5, a perforated well wall casing 32 of a relatively small diameter consists of a plurality of such casing elements connected end-to-end which stand upon the bottom of the bore of the well within the solid well casing portion indicated at 33. The space 34 formed between the perforated casing 32 and the solid casing 33 is sealed by means of a plate 35 positioned on the upper end of the perforated casing 32 to form a carrier or mounting structure for the suction current control unit 14–19. A plate 35 has a central circular opening therein for loosely receiving a connecting tube 36. A further plate 37 also having a circular opening therein is welded to the upper end of the connecting tube 36 and is provided with a bracket 38 by means of which the unit can be lowered or raised. Positioned between the two plates 35 and 37 is a rubber sleeve 39 which may be in the form of a hose. Attached to the connecting tube 36 is the uppermost element 14 of the suction current control unit and the weight of this unit loads the rubber sleeve so that a lateral sealing is produced with respect to the solid casing portion 33 of the well. While not shown in this figure, the pump is freely suspended in the solid well casing portion 33 of the well.

FIG. 6 illustrates schematically the operation of a suction current control element in accordance with the present invention. Nine elements 40–48 are interconnected end-to-end with the necessary centering guides to form a complete suction current control unit which is then connected to a pump 12 having a capacity of, for example, 40 liters per second. Each of the individual elements 40–48 receives a free flow of water of 4.5 liters per second so that a total of 40.5 liters of water per second are available to the pump in the interior of the control unit. By employing a suction current control in accordance with the present invention the rate of flow at the intake of the pump is limited in its effect upon the interior space of the well, namely, the space enclosed by the suction current control. As a result, any turbulence which may be produced by the suction effect of the pump is limited to this interior space of the well and is not propogated through the openings of the perforated well casing outwardly into the water-bearing strata where it might cause sand to flow into the well. The water rising within the well can thus flow in uniformly over the entire length of the perforated wall of the well which is opposite to the suction current control. An increased flow of water from the uppermost water-bearing strata which lies next to the suction opening of the pump and which might lead to an increased entraining of sand in the water is thus avoided. The water is thus also withdrawn from the lower lying water bearing strata.

It is to be understood that the present apparatus is not limited to the embodiments and modifications as disclosed herein. For example, another body of a certain permeability or porosity can also be employed instead of utilizing two concentric tubes with a granulate filling therebetween. For example, a cylindrical body of a certain porosity may be used without the inner and outer concentric tubes in the event that the cylindrical body has sufficient rigidity and structural strength.

Thus it can be seen that the present invention has disclosed a method and apparatus for withdrawing water from a water-bearing strata without there being a high content of sand in the water. The drawing of sand-free water not only significantly lengthens the life of the pumps used to pump water from the well but also avoids the danger of subsistence of the ground surrounding the well because of the withdrawal of sand from the water-bearing strata.

It is to be noted that when the well deviates from the vertical the several elements can be interconnected by flexible plug and sleeve connections. Such a connection also facilitates the transport of the elements from well to well. The connections between the individual elements may have a sufficient degree of flexibility depending upon the path taken by the well instead of the rigid connections disclosed herein.

It will be understood that this invention is susceptible to modification in order to adapt it to different usages and conditions, and accordingly, it is desired to comprehend such modifications within this invention as may fall within the scope of the appended claims.

What is claimed is:

1. A process for drawing water free from sand from a well bored into a water-bearing strata and preventing water from being drawn into a pump at high speed, the steps of flowing the water into the well from a water-bearing strata through a plurality of openings distributed over a surface of a predetermined length of a wall of the well, the water flowing into the well under natural flow characteristics and below the inertia force of any sand in the strata, flowing the water within the well through a permeable body into a restricted space in the interior of the well, controlling the rate of flow of water through the permeable body such that the quantity of water flowing into the restricted space corresponds to the natural flow of water from the strata and to the pumping capacity of a pump connected to the permeable body such that the quantity of water to be pumped will flow into the restricted space without any force by the pump, and distributing the pump action of the water from the restricted space over the entire length of the permeable body and over the predetermined length of the perforated wall of the well.

2. An apparatus for drawing water free of sand from a well bored into a water-bearing strata comprising a tubular filter element perforated over a predetermined length thereof to define a well wall, a cylindrical suction control element having a permeable wall through which water flows and disposed concentrically within said well wall and extending through the predetermined length of the well wall, the upper portion of said permeable suction control element being at the same depth as the upper perforations in said well wall, the lower end of said cylindrical suction control element being closed and the upper end thereof being open, a pump having an inlet tightly connected to the upper end of said suction control element, said suction control element having a surface area, length and permeability such that the rate of flow of water through the permeable wall corresponds to the natural flow characteristics of water in the strata and below the inertia force of any sand in the strata, the pump having a capacity corresponding to the quantity of water flowing into the suction control element per unit time, the water flowing from the strata into the well without any suction force by the pump.

3. An apparatus as claimed in claim 2 wherein said cylindrical body comprises slotted outer and inner concentric tubes and a granulate of uniform particle size therebetween.

4. An apparatus as claimed in claim 3 wherein said granulate has different particle sizes.

5. An apparatus as claimed in claim 2 wherein said cylindrical body comprises slotted outer and inner concentric tubes and a permeable cylinder therebetween.

6. An apparatus as claimed in claim 2 and a plurality of cylindrical permeable bodies connected end-to-end to define suction current control means.

7. An apparatus as claimed in claim 6 and means for rigidly connecting said cylindrical permeable bodies.

8. An apparatus as claimed in claim 6 and means for flexibly connecting said cylindrical permeable bodies.

9. An apparatus as claimed in claim 2 and means for centering said cylindrical body within said well wall.

10. An apparatus as claimed in claim 2 and a cylindrical casing having one end connected to the upper end of said cylindrical body and the other end being closed, and a submersible pump within said cylindrical casing.

* * * * *